United States Patent [19]

Levi et al.

[11] 4,391,307

[45] Jul. 5, 1983

[54] WIRE STRAIGHTENING AND CUTTING MECHANISM

[75] Inventors: George W. Levi, Littleton; Kalman Kanyo, Westminster, both of Colo.

[73] Assignee: G&D, Inc., Denver, Colo.

[21] Appl. No.: 229,781

[22] Filed: Jan. 30, 1981

[51] Int. Cl.[3] ..... B21F 1/02

[52] U.S. Cl. ..... 140/140; 72/79; 72/160; 72/185

[58] Field of Search ..... 140/139, 140, 147, 149; 83/345, 346; 72/79, 185, 160; 361/267; 72/164

[56] References Cited

U.S. PATENT DOCUMENTS

| | | | |
|---|---|---|---|
| 437,413 | 9/1890 | Eckerson . | |
| 973,571 | 10/1910 | Shuster . | |
| 988,197 | 3/1911 | Lewis . | |
| 1,435,438 | 11/1922 | Wright . | |
| 1,714,094 | 5/1929 | Kilmer . | |
| 1,925,845 | 9/1933 | Moore | 140/140 |
| 2,938,549 | 5/1960 | Rangobe | 140/140 |
| 3,110,208 | 11/1963 | Mitchell | 83/345 |
| 3,277,682 | 10/1966 | Kaestner | 72/164 |
| 4,237,518 | 12/1980 | Krulwich | 361/267 |

*Primary Examiner*—Lowell A. Larson
*Assistant Examiner*—Linda McLaughlin
*Attorney, Agent, or Firm*—John E. Reilly

[57] ABSTRACT

Improvements have been devised in wire straightening and cutting apparatus to the end of protecting the external coating on the wire as it is advanced, straightened and then cut to a predetermined length and are specifically directed to the novel arrangement of feed rollers upstream of a bending spindle to positively force the wire through the bending spindle, demagnetizer and cutter section in such a way as not to damage the external surface of the wire or remove any coating on the wire. A cutting mechanism is correlated with the driving of the feed rollers to cut the wire, once straightened, into predetermined lengths; also, the length of wire cut can be varied simply by varying the speed of the cutter relative to the speed of advancement of the wire.

18 Claims, 7 Drawing Figures

WIRE STRAIGHTENING AND CUTTING MECHANISM

This invention relates to a new and useful method and means for straightening and cutting wire and more particularly relates to novel and improved apparatus for advancing wire from a continuous roll through a straightening mechanism following by cutting into predetermined lengths.

BACKGROUND AND FIELD OF THE INVENTION

In straightening and cutting a continuous length of wire into segments of predetermined length, it has been customary practice to draw the wire through a rotary spindle which imparts a simultaneous bend and twist to the wire causing it to become absolutely straight, following which the wire is continually advanced through a cutter section and severed into predetermined lengths. Such mechanisms have innumerable applications, but for instance are utilized in the formation of sewing needles, corduroy needle guides and electrical components which require wire connectors. Generally, among the difficulties attending the use of conventional wire straightening and cutting mechanisms, there has been a tendency to deface or mar the surface of the wire when it is engaged and drawn through the bending spindle as well as to deform the ends of the wire when it is passed through the cutter section. Representative of approaches taken in the past is that disclosed in U.S. Patent to Moore No. 1,925,845 in which the wire is drawn by feed rollers through a rotating spindle, and as the wire exits from the spindle is passed through a tubular guide into a cutter mechanism where the wire is severed into predetermined lengths. Here an electromagnetic circuit is employed to prevent any back thrust or undue tension in the cutting operation. Similarly, U.S. Patent to Rangabe No. 2,938,549 is directed to the use of a feed roller mechanism to advance the wire into contact with a stop member, the wire being gripped by jaw members which when activated will stretch the wire prior to the severing operation so as to eliminate any tendency of the wire to curl. Upon activation of a contact member, magnetic devices are energized and a carriage assembly is advanced a sufficient distance to cause breakage of the stretched wire so as to form a taper at the severed ends of the wire. Other representative patents disclosing various approaches to straightening and cutting of wire in automatic operations are U.S. Pat. Nos. 437,413 to Eckerson; 973,571 to Shuster; 988,197 to Lewis; 1,435,438 to Wright; and 1,714,094 to Kilmer. It has been found, however, that drawing of the wire from a point downstream of the bending spindle, as typified by the prior art referred to above, whether by the use of feed rollers, jaws or check mechanisms can damage the external surface or coating on the wire. This can be aggravated by undue friction imposed upon the advancement of the wire both through the bending spindle and cutter section.

SUMMARY OF THE INVENTION

It is therefore an object of the present invention to provide for a novel and improved apparatus for handling and cutting wire, is adaptable for cutting wire of different lengths and sizes, and which is capable of straightening wire and feeding same through a cutter section without damaging or distorting the wire.

Another object of the present invention is to provide for a wire straightening and cutting mechanism which is capable of cutting wire into predetermined lengths from a continuous length of wire in a high speed operation, and is readily adjustable to cut different lengths of wire while maintaining the wire perfectly straight.

A further object of the present invention is to provide for a novel and improved method and means for cutting wire into predetermined lengths in a high speed operation which offers minimum resistance or friction to the movement of the wire in the course of its straightening and in such a way as not to damage the external surface or surface coating of the wire.

An additional object of the present invention is to provide for a novel and improved method of advancing a wire from a continuous spool by positively forcing through a bending spindle from a point upstream of the spindle, floating the wire from the bending spindle through a tubular guide into a cutter section in which a rotary blade is advanced or rotated in the same direction as the advancement of the wire but at a lesser speed and where the speed of rotation of the blade is correlated with the rate of advancement of the wire.

A preferred form of the present invention resides in a wire straightening and cutting mechanism in which a wire is advanced from a coil, first through feed rollers which positively advance the wire through a bending spindle. At least one of the feed rollers is spring-loaded to pinch the wire therebetween and advance it into the bending spindle. The bending spindle consists of a series of oppositely directed, notched pegs with the wire advancing through the notches in the pegs and being bent in opposite directions. In a conventional manner, the bending spindle will introduce a number of oppositely directed bends into the wire while rotating it at high speeds and cause it to be straightened as a preliminary to advancing through additional tubular guides, then through a demagnetizer into a cutter section. In the cutter section, a rotary cutter has a blade which rotates in the same direction as the advancement of the wire, but at a slightly lesser speed. The speed of the cutter is set merely to cut the wire to a predetermined length; and for example by increasing the speed would cut shorter lengths of the wire for a given speed of the feed rollers. The principle of pushing or forcing the wire from the lead end of the machine, as opposed to drawing the wire, has been found to greatly improve the straightening operation while avoiding objectionable wear or removal of the outer coating. This is particularly true where the wire is provided with an outside coating, such as tin and the gripping or clamping mechanism will tend to remove the coating from the wire in positively advancing it through the straightening and cutter sections.

Moreover, in addition to positively advancing the wire from the lead end of the machine, the notched pegs formed in the spindle section are composed of a low coefficient of friction material which will offer the least resistance to advancement of the wire therethrough as the wire is simultaneously bent and twisted by the bending spindle. The wire is then permitted to float from the bending spindle through a demagnetizer coil as a preliminary to advancement through the cutter section. The speed of the cutter blade in the cutter section is correlated with the rate of advancement of the wire and is adjusted to regulate the length of wires cut while operating in coordination with a journaled anvil to effect a clean cut without distorting the wire.

The above and other objects, advantages and features of the present invention will become more readily appreciated and understood from a consideration of the following detailed description of a preferred embodiment of the present invention when taken together with the accompanying drawings, in which:

DETAILED DESCRIPTION OF THE PREFERRED EMBODIMENT

Figure 1:
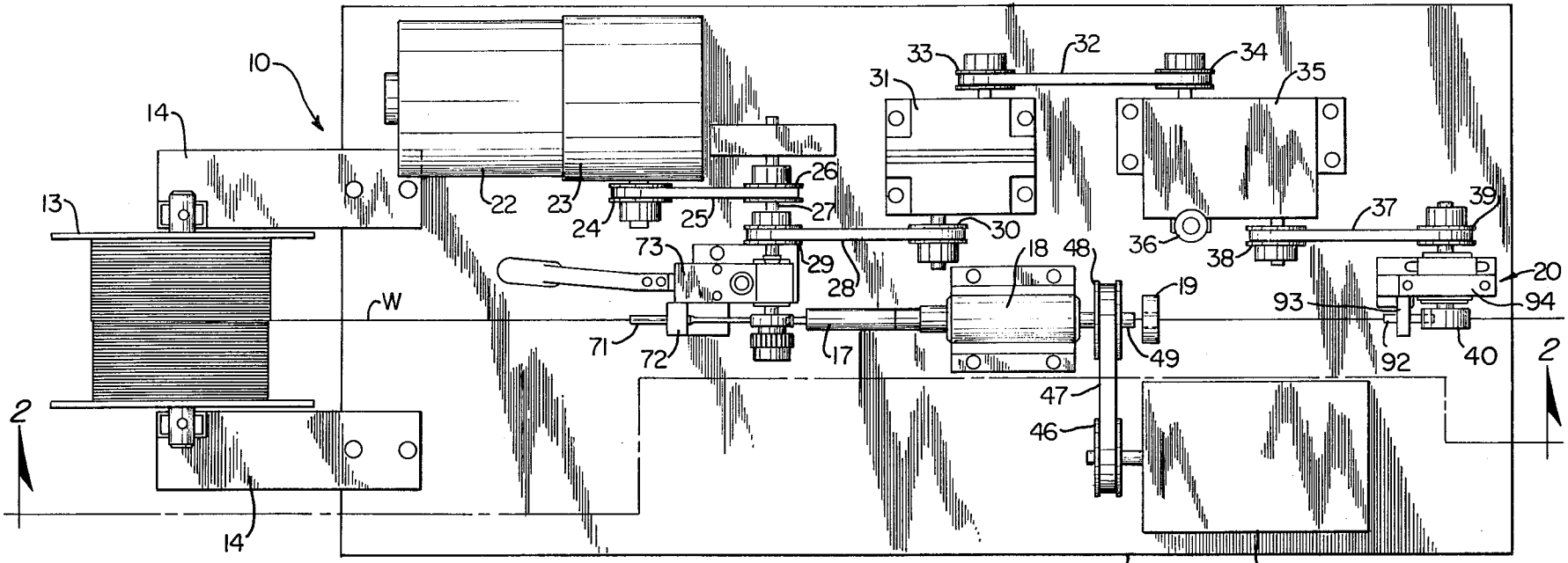
FIG. 1 is a top plan view of a preferred form of wire straightening and cutting mechanism according to the present invention.

Referring in detail to the drawings, a preferred form of wire straightening and cutting mechanism 10 is shown mounted on an elevated bed or table 12 and is broadly comprised of a supply roll for a coil of wire 13 removably supported on spaced brackets 14 at one end of the table 12. A pair of feed rollers 15 and 16 serve to draw the wire as represented at W directly off the coil 13 and to advance it into a rotating spindle 17. From the spindle section, the wire is advanced through a guide or float section 18 which includes a demagnetizer 19 at one end and from which the wire advances into a cutter section generally designated at 20. Brief reference will be made to the drive system which is comprised of standard motor and speed reducers to properly coordinate the rotation of the feed rollers 15, 16, spindle 17 and the rotary cutter 20. To this end, a main motor drive 22 includes a speed reducer 23 into a drive pulley 24 for power transmission belt 25 which is trained over a driven pulley 26 on shaft 27 which is drivingly connected to the lower feed roller 16. Another power transmission belt 28 is trained over pulleys 29 and 30 to impart rotation of the shaft 27 into another speed reducer 31 which, through a power transmission belt 32 trained over pulleys 33 and 34, leads into a speed changer 35. The speed changer 35 includes a manually adjustable control 36 to regulate the effective speed of the speed changer through power transmission belt 37 which is trained between pulleys 38 and 39 on the output shaft of the speed changer 35 and input shaft of cutter 20, respectively.

Figure 2:
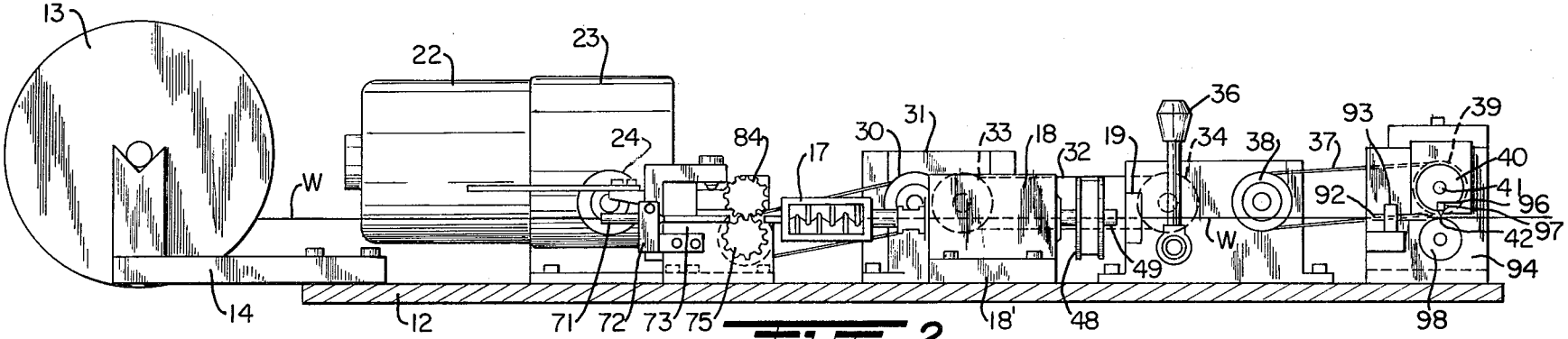
FIG. 2 is a side view in elevation of the preferred form of invention shown in FIG. 1.

A rotary cutter wheel 40 is keyed to the input shaft 41 and includes a cutter blade 42 which is rotated in the direction indicated in FIG. 2 to repetitively advance the cutter blade 42 across the path of travel of a wire W in severing it into predetermined lengths. Generally, the speed relationship established between the cutter wheel 40 and feed roller will be determined by the desired length of wire. A separate spindle drive 45 is operative through its drive pulley 46 and power transmission belt 47 leading from the drive pulley 46 onto a driven pulley 48 which is keyed to spindle drive shaft 49 to drive the spindle at a fixed rate of speed.

Figure 3:
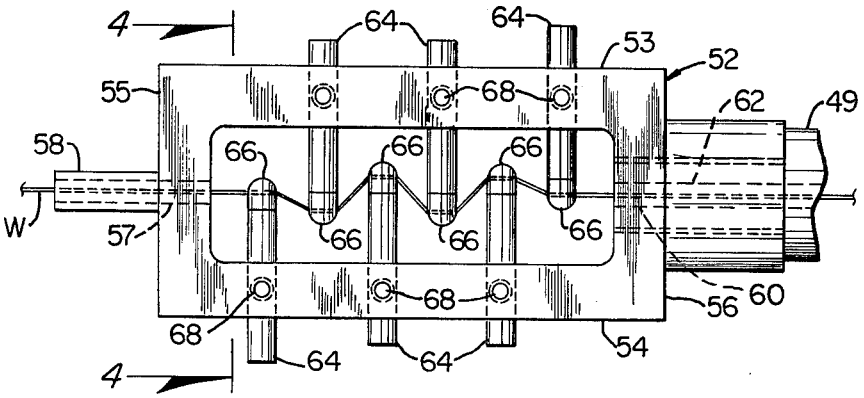
FIG. 3 is an enlarged view in detail of a preferred form of bending spindle.
Figure 4:
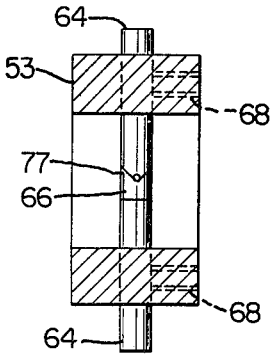
FIG. 4 is a cross-sectional view taken about lines 4—4 of FIG. 3.

In accordance with conventional practice, the spindle drive 17 operates on the basic concept of introducing a series of reverse bends into the wire W as it is simultaneously rotated or twisted at high speeds while under continuous advancement through the spindle. For this purpose, the spindle drive shaft 49 is connected to a generally rectangular frame 52 which has upper and lower spaced walls 53 and 54 on opposite sides of the path of travel of the wire W, the walls being interconnected by end walls 55 and 56. The wire W is led into the frame through an aperture 57 located centrally of the end wall 55 and which is aligned with a sleeve 58 projecting externally of the end wall 55. Another aperture 60 is disposed in the opposite end wall 56 and is aligned with a hollow bore 62 which extends centrally through the spindle drive shaft 49. In this relation, the apertures 57 and 60 are aligned symmetrically about the longitudinal axis of extension of the wire in opposite ends 55 and 56 of the frame 52. A series of pegs 64 are arranged for extension alternately in opposite directions through the upper and lower walls 53 and 54, the pegs extending transversely of the length of the wire W and at equally spaced intervals, each terminating in a notched end portion 66. Each peg is of generally rectangular or square cross-section and extends through a correspondingly square opening intermediately or centrally of a wall 53 or 54. The degree of extension of each peg into the hollow interior of the frame is regulated by suitable fasteners in the form of locking screws 68 which, as illustrated in FIGS. 3 and 4, extend through the thickness of the upper and lower walls 53 and 54 to clampingly engage a side of the peg within its opening so as to retain it securely in place. As illustrated, the peg 64 at opposite ends of the frame 52 have their notched end portions 66 aligned with the longitudinal axis of the wire, but the intermediate pegs project a greater distance across the interior and beyond the longitudinal axis of the wire so that when the wire is threaded through the peg 64 a series of reverse bends is introduced into the wire between opposite ends of the frame. As best seen from FIG. 4, each notched end portion 66 is provided with a relatively broad, shallow, V-shaped notch 77 such that the wire will ride along the apex of the notch. Further, each notched end portion 66 is composed of a low coefficient of friction material, such as, for instance, nylon, so as to introduce but minimal resistance to the longitudinal advancement of the wire therethrough.

Figure 5:
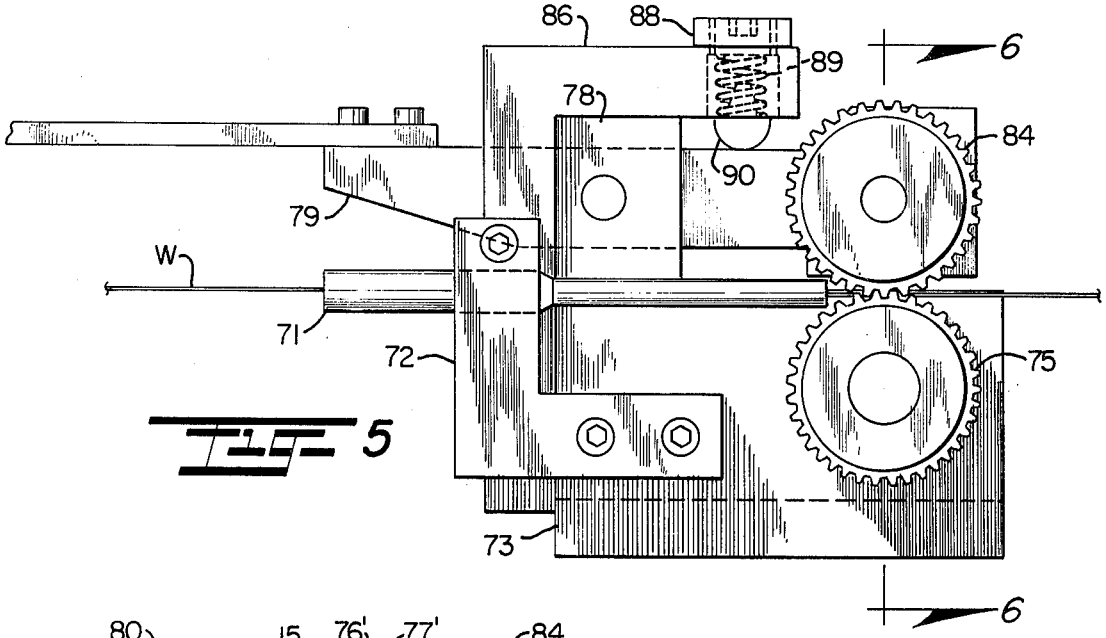
FIG. 5 is a view enlarged and in detail of the preferred form of feed rollers.
Figure 6:
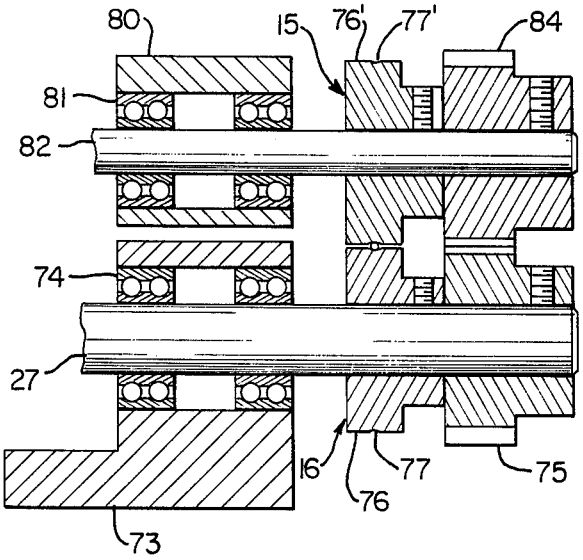
FIG. 6 is a cross-sectional view taken about lines 6—6 of FIG. 5.
Figure 7:
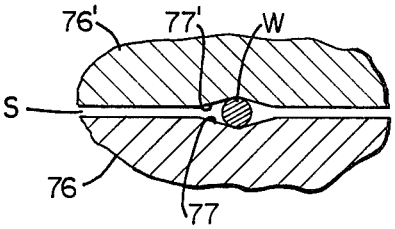
FIG. 7 is an enlarged view in section illustrating the clamping of the wire between confronting surfaces of the feed rollers.

An important feature of the present invention resides in the mounting of the feed rollers 15 and 16 in leading relation to or upstream of the spindle drive. As shown in FIGS. 5 to 7, the wire W is drawn horizontally from the coil through a guide sleeve 71 mounted in a guide block 72 which forms a lateral or horizontal extension of the support block 73. The block 73 is anchored to the table 12 and is provided with a transverse bore for insertion of bearing 74 for the feed roller drive shaft 27 the latter projecting through the block 73 and extending directly beneath the path of travel of the wire W. The feed roller 16 together with a spur gear 75 are locked on the drive shaft 27 as shown and the feed roller includes an enlarged cylindrical portion 76 provided with a notched portion 77 arranged for rotation such that the uppermost point on the external cylindrical surface of the roller will advance along the longitudinal axis of the wire. The support block 73 additionally includes an upward projection 78 for pivotal mounting of an arm 79 which extends over the support block 73 in the direction of wire extension and terminates in a bearing retainer 80 for bearings 81 disposed in surrounding relation to a follower shaft 82 for the upper feed follower shaft 82 and aligned directly above the spur gear 75 for intermeshing engagement therewith while the feed roller 15 similarly is provided with a cylindrical surface portion 76' provided with a notched portion 77' aligned with the notched portion 77 of the lower feed roller, as illustrated in detail in FIG. 7.

In order to urge the upper feed roller 15 yieldingly into engagement with the lower feed roller 16, a fixed spring retainer arm 86 is secured to the block 73 for extension in spaced relation above the arm 79, and a spring housing 88 is arranged in a vertical bore formed in the free end of the arm 86 to receive compression spring 89 which urges a stud 90 downwardly against the free end of the arm 79. In this manner, the upper feed roller 15 is urged downwardly toward the lower feed roller 16 but is limited by the intermeshing engagement of the gears 75 and 84 so that a slight clearance, as represented at S in FIG. 7, is left between the confronting surfaces of the cylindrical portions 76 and 76' which clearance is less than the diameter of the wire. The shallow notched portions 77 and 77' will maintain axial alignment of the wire for continuous advancement between the confronting cylindrical surfaces while exerting sufficient pressure against the wire to positively advance it into the spindle drive section as described.

The pressure feed rollers exert sufficient clamping action on the wire to positively advance it from the supply roll through the bending spindle 17 where the wire is straightened, following which it is advanced through the float section 18 and demagnetizer coil 19 toward the cutter section 20. The float section 18 is in the form of a hollow cylinder which is affixed by a base support 18' to the table and has a demagnetizer coil 19 positioned at the trailing end of the float section to neutralize any magnetism or static electricity developed in the wire as it undergoes straightening in the spindle section. In the cutter section, a sleeve 92 is positioned in a guide post 93 extending from main support block 94 and which support block is affixed to the table 12. The cutter disk 40 is mounted on a drive shaft 41, the latter journaled in bearings, not shown, in the upper portion of the support block 94. The cutter disk has a chordal section or segment removed as at 96, and the cutter blade 42 is inserted radially into the disk at the corner of the chordal segment and locked in position by a fastener, such as, a locking screw 97 so that the cutting edge of the blade projects radially beyond the periphery of the disk. Cooperating with the cutter disk is a generally cylindrical anvil 98 which is journaled for rotation on the support block directly beneath the cutter disk. The external cylindrical surface of the anvil 98 is positioned for advancement such that its uppermost point is disposed on the wire axis and forms a movable support surface for the cutter blade as it is rotated into engagement with the wire. The anvil disk will be under somewhat continuous rotation owing to the movement of the wire across its upper surface and, as the cutter blade moves into engagement with the wire, the anvil disk will effectively pinch the wire between the cutter blade and anvil surface while moving with the cutter blade as its severs the wire. The length of wire cut is determined by the speed of rotation of the cutter blade relative to the rate of advancement of the wire and in the preferred form as shown the rotation of the cutter blade is manually controllable by the Zero-Max control handle 36.

The method of the present invention may be best exemplified by reference to its use in the formation of corduroy needle guides which are typically formed from a steel wire having an extremely thin tin coating, the wire being on the order of 0.010" to 0.012" in diameter. Although the length of the needle guides may vary, in forming needle guides on the order of 10½" in length, the speed of rotation of the rotary cutter is set such that it will undergo one revolution for 10½" lineal or axial advancement of the wire each along a guide path. More specifically, in the method of the present invention the feed rollers 15 and 16 engage the wire directly upstream of the straightening section or bending spindle 17 and in succession advance the wire continuously through the bending spindle, float section 18, demagnetizer 19 and past the cutter section where counter-rotating rollers, one of which includes the rotary cutter, severs the wire at predetermined intervals. It has been found that engagement of the wire by the feed rollers and specifically the aligned, notched portions of the feed rollers affords the necessary gripping action to advance the wire along the complete guide path without damaging the external surface of the wire, since the bending spindle and cutter section impose a minimum of frictional resistance or drag to the movement of the wire therethrough.

It is therefore to be understood from the foregoing that while a preferred form of method and apparatus has been disclosed, various modifications and changes may be made in the specific sequence of steps, construction and arrangement of parts without departing from the spirit and scope thereof as defined by the appended claims.

We claim:

1. In a wire straightening and cutting apparatus adapted to cut wire of varying lengths from a supply source having a continuous length of wire, wire feeding means for advancing said continuous length of wire in a lengthwise direction from said supply source, wire straightening means downstream of said feeding means through which said continuous length of wire is advanced, and guide means downstream of said wire straightening means to permit said continuous length of wire to float unrestrained from said wire straightening means, and a cutter mechanism including a cutter blade and rotary drive means for rotating said cutter blade in correlated relation to said wire feeding means including means to vary the speed of rotation of said cutter blade in relation to the rate of advancement of said wire as established by said feeding means in regulating the length of wire which is cut by said cutter blade.

2. In apparatus according to claim 1, said cutter mechanism including an anvil on one side of said wire opposite to said cutter blade to support said wire as it is being cut by said cutter blade.

3. In apparatus according to claim 2, said anvil being journaled for rotation beneath said cutter blade so as to be engageable with said wire along the path of advancement of said wire.

4. In apparatus according to claim 1, said feed means frictionally engaging said wire whereby to force said wire throughout its path of travel from said supply source through said cutter mechanism.

5. In apparatus according to claim 1, said feed means defined by a pair of feed rolls arranged with cooperating notches on their outer peripheral surfaces, and intermeshing gears on said feed rolls to synchronously rotate the outer peripheral surfaces of said feed rolls with the wire aligned in said notches and advanced in a lengthwise direction therethrough.

6. In apparatus according to claim 5, further characterized by employing common drive means for said feed rolls and said cutter blade drive means.

7. In apparatus according to claim 5, one of said feed rolls being spring-loaded against the other of said feed rolls to yieldingly engage said wire therebetween.

8. In apparatus according to claim 7, said feed rolls having aligned notch portions for reception of said wire.

9. In apparatus according to claim 7, including means pivotally mounting one of said feed rolls with respect to the other of said feed rolls and having bias means yieldingly urging said one feed roll against the other of said feed rolls.

10. In apparatus according to claim 1, said wire straightening means including spindle drive means having transversely extending pegs in axially spaced relation to one another and provided with notched portions at the end of each peg to introduce a predetermined bend into said wire, and means for rotating said spindle independently of the advancement of said wire through said spindle.

11. In apparatus according to claim 10, each of said pegs having notched end portions composed of a low coefficient of friction material.

12. A wire straightening and cutting apparatus adapted to cut wire of varying lengths from a continuous length of wire, said apparatus comprising:

wire feeding means for advancing said continuous length of wire in a lengthwise direction at a location upstream of said wire straightening and cutting apparatus, straightening means downstream of said feeding means for rotating and straightening said continuous length of wire as it is advanced therethrough, a wire demagnetizer downstream of said straightening means, and guide means between said wire straightening means and demagnetizer means to float said wire unrestrained from said wire straightening means through said demagnetizer; and a cutter mechanism including a cutter blade and rotary drive means for rotating said cutter blade in correlated relation to said feeding means, an anvil on one side of said wire opposite to said cutter blade to support said wire as it is being cut by said cutter blade, and means to vary the speed of rotation of said cutter blade in relation to the rate of advancement of said wire in regulating the length of wire which is cut by said cutter blade.

13. Apparatus according to claim 12, said feeding means operative to force said wire throughout its path of travel from a supply roll through said cutting mechanism.

14. Apparatus according to claim 12, said anvil being journaled for rotation beneath said cutter blade so as to be engageable with said wire along the path of advancement of said wire.

15. Apparatus according to claim 14, said feeding means defined by a pair of feed rolls arranged with cooperating notches on their outer peripheral surfaces, intermeshing gears on said feed rolls to synchronously rotate the outer peripheral surfaces of feed rolls with the wire aligned at said notches and advanced in a lengthwise direction therethrough, and drive means for rotating one of said feed rolls.

16. Apparatus according to claim 15, further characterized by employing common drive means for said feed rolls and said cutter blade drive means, and one of said feed rolls being spring-loaded against the other of said feed rolls to yieldingly engage said wire therebetween.

17. Apparatus according to claim 16, including means pivotally mounting one of said feed rolls with respect to the other of said feed rolls and having bias means yieldingly urging said one feed roll against the other of said feed rolls.

18. Apparatus according to claim 12, said wire straightening means including spindle drive means having transversely extending pegs in axially spaced relation to one another and provided with notched portions at the end of each peg to introduce a predetermined bend into said wire, and means for rotating said spindle at a constant speed independently of the advancement of said wire through said spindle.

* * * * *